US007040514B2

(12) United States Patent
Colan et al.

(10) Patent No.: US 7,040,514 B2
(45) Date of Patent: May 9, 2006

(54) MEMBRANE ACTIVATED CARBONATED BEVERAGE DISPENSER

(76) Inventors: Mihail Octavian Colan, 101 10680 151A Street, Surrey, British Columbia (CA) V3R 8T4; Laurentiu Victor Bucuroiu, 11344 89th Avenue, Delta, British Columbia (CA) V4C 3G1

( * ) Notice: Subject to any disclaimer, the term of this patent is extended or adjusted under 35 U.S.C. 154(b) by 1 day.

(21) Appl. No.: 10/828,177

(22) Filed: Apr. 21, 2004

(65) Prior Publication Data

US 2005/0236439 A1 Oct. 27, 2005

(51) Int. Cl.
*B65D 83/00* (2006.01)

(52) U.S. Cl. ..... 222/402.13; 222/464.4; 222/513; 222/553

(58) Field of Classification Search ..... 222/402.1, 222/402.13, 402.25, 464.1, 513, 549, 551, 222/553
See application file for complete search history.

(56) References Cited

U.S. PATENT DOCUMENTS

| | | | | |
|---|---|---|---|---|
| 2,830,745 | A * | 4/1958 | Bartoll Aicart | 222/323 |
| 4,194,653 | A | 3/1980 | Brown | |
| 4,671,435 | A | 6/1987 | Stout et al. | |
| 4,694,975 | A | 9/1987 | Hagan | |
| 4,726,190 | A | 2/1988 | Van Marcke | |
| 4,773,571 | A * | 9/1988 | Hagan et al. | 222/394 |
| 4,848,600 | A | 7/1989 | Dark | |
| 4,860,932 | A | 8/1989 | Nagy | |
| 4,934,543 | A | 6/1990 | Schmidt | |
| 4,995,534 | A | 2/1991 | Norman | |
| 5,348,200 | A | 9/1994 | Van Den Berghe | |
| 5,390,832 | A | 2/1995 | Lombardo | |
| 5,447,257 | A * | 9/1995 | Dark | 222/336 |
| 6,095,379 | A * | 8/2000 | Martinez et al. | 222/402.13 |
| 6,202,901 | B1 | 3/2001 | Gerber et al. | |
| 6,213,351 | B1 | 4/2001 | Stoneberg et al. | |
| 6,299,027 | B1 | 10/2001 | Berge et al. | |
| 6,341,721 | B1 | 1/2002 | Herald et al. | |
| 6,401,752 | B1 | 6/2002 | Blackbourn et al. | |
| 6,470,910 | B1 | 10/2002 | Blackbourn et al. | |
| 6,491,189 | B1 | 12/2002 | Friedman | |
| 2002/0108973 | A1 | 8/2002 | Roethel et al. | |
| 2002/0179616 | A1 | 12/2002 | Elder | |

FOREIGN PATENT DOCUMENTS

| | | |
|---|---|---|
| WO | WO 99/44915 | 9/1999 |

OTHER PUBLICATIONS 7 photographs of dispenser for bag-in-box apple juice produced by Sun-Rype Products Ltd., Kelowna, BC V1Y 2W4, Canada, date published unknown.

* cited by examiner

*Primary Examiner*—Joseph A. Kaufman
(74) *Attorney, Agent, or Firm*—Oyen Wiggs Green & Mutala LLP; Mark A. Hopkinson

(57) ABSTRACT

A dispenser for dispensing fluid from a container has a shell having an inlet, an outlet, a dispensing chamber, and a mechanism for attaching the dispenser to a top portion of a container, such as a carbonated beverage bottle. An obstructor is movable between a closed position and an open position to allow fluid flow between the inlet and the dispensing outlet. A membrane pin is coupled to a resilient membrane and to the obstructor such that depression of the membrane will result in displacement of the obstructor, moving the obstructor between the closed and open positions. A siphon draws fluid from the container into the dispensing chamber.

23 Claims, 7 Drawing Sheets

MEMBRANE ACTIVATED CARBONATED BEVERAGE DISPENSER

FIELD OF INVENTION

This invention relates to fluid dispensers and more specifically to a bottle top for the controlled dispensing of pressurized or carbonated beverages.

BACKGROUND

Carbonated beverages are commonly provided to consumers in bottles. To dispense liquid from a carbonated beverage bottle, a consumer typically unscrews a bottle top and pours the drink into a drinking container. To re-seal the carbonated beverage container, the consumer reattaches the bottle top. A common problem with this type of sealing apparatus is that after a first use, the carbonated beverage steadily loses carbonation and goes "flat". There exists a need for a bottle top dispensing means that easily dispenses carbonated beverages into a drinking container yet preserves the carbonation in the portion of the carbonated beverage remaining in the container.

U.S. Pat. No. 4,860,932 to Nagy discloses a bottle siphon and dispenser for carbonated beverages that operates by placing pressure on a lever, which displaces an obstructor and allows a liquid to be dispensed. Nagy discloses that a portion of the obstructor passes through an opening in the dispenser body and makes contact with the lever. There is an imperfect seal in the dispensing chamber between the obstructor and the dispenser body. Nagy attempts to reduce the problem of this imperfect seal by positioning an O-ring around the obstructor in the area in which it passes through the dispenser body. This arrangement is relatively expensive to make and the imperfect seal is less than desirable, particularly since the obstructor moves up and down with respect to the dispenser body.

Other dispensers have attempted to improve the process of dispensing of carbonated beverages with limited success. Shortcomings of existing dispensers, such as disclosed by Nagy, include expensive and complicated construction, leaky valves, and the dispenser being too large such that it cannot fit on current carbonated beverage bottles when the bottles are stacked in standard shipping crates.

There is a need for a liquid dispenser for carbonated beverages which has a sealed dispensing chamber that is not penetrated by an obstructor, and where the obstructor is guided into making a proper seal by shaping the obstructor and the dispensing body in a suitable fashion, or by centering the obstructor within the dispenser body.

There further remains a need for a dispenser of relatively inexpensive construction and small in size such that it may be used on carbonated beverage bottles stacked in existing shipping crates.

SUMMARY OF INVENTION

A shell of a dispenser for dispensing fluid from a container has an inlet, an outlet, a dispensing chamber, and a mechanism to attach the shell to a top portion of the container. A membrane pin is coupled to a membrane and to an obstructor such that depression of the membrane results in displacement of the obstructor. The obstructor is movable between a closed position that prevents the flow of fluid between the inlet and the outlet and an open position that allows flow between the inlet and the outlet.

The height of the dispenser when attached to a container is between about 1 cm and about 4 cm measured from the uppermost surface of the container to the uppermost surface of the dispenser.

A siphon may be coupled to the shell in a fluid tight seal for dispensing pressurized fluids such as carbonated beverages.

BRIEF DESCRIPTION OF DRAWINGS

In figures which illustrate non-limiting embodiments of the invention.

DESCRIPTION

Throughout the following description specific details are set forth in order to provide a more thorough understanding of the invention. However, the invention may be practiced without these particulars. In other instances, well known elements have not been shown or described in detail to avoid unnecessarily obscuring the present invention. Accordingly, the specification and drawings are to be regarded in an illustrative, rather than a restrictive, sense.

Figure 1:
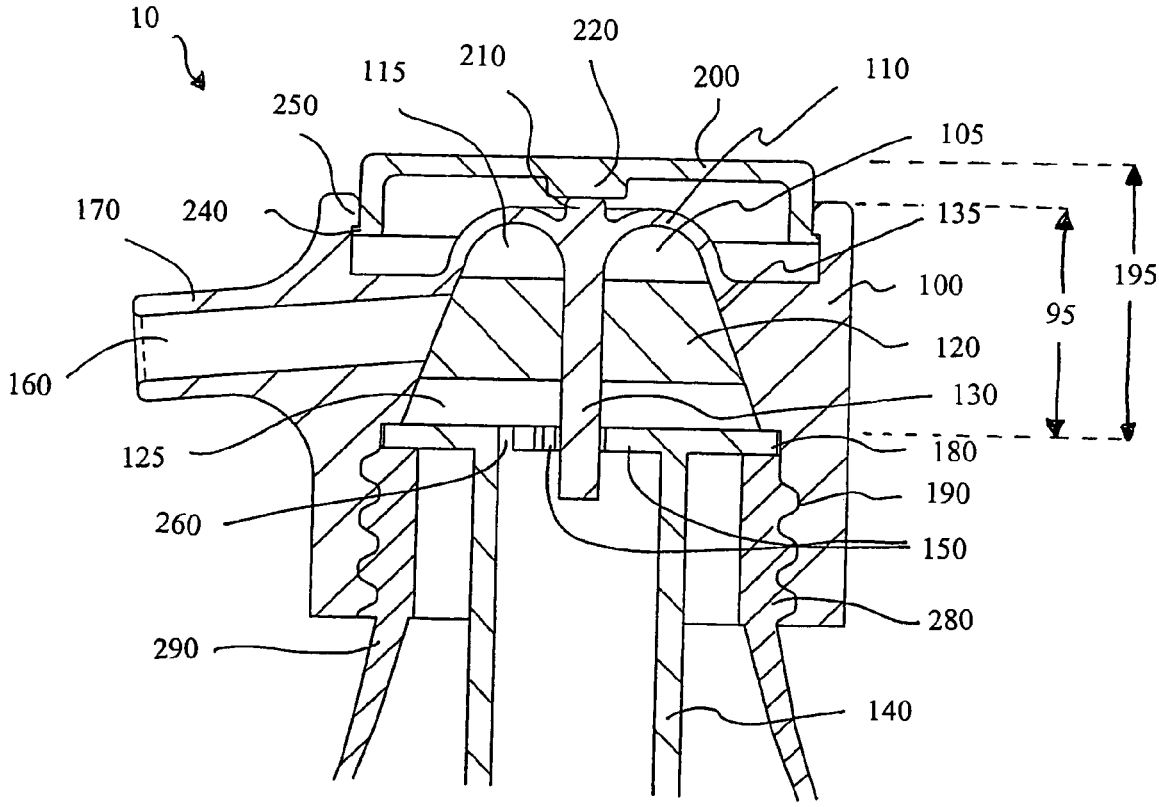
FIG. 1 is a cross-sectional side view of a button-operated dispenser embodiment in the closed position.

As shown in FIG. 1, a button operated dispenser 10 has a dispenser shell 100, a dispensing chamber 105, and a dispensing spout 170 that has a dispensing channel 160 passing therethrough and serving as an outlet from the dispensing chamber 105. In the closed position shown in FIG. 1, the entrance to the dispensing channel 160 is blocked by an obstructor 120. The obstructor 120 is movable between the closed position and an open position, shown in FIG. 2, by depressing a membrane 110 that is coupled to the dispensing shell 100. The membrane 110 has a membrane pin 130 that extends through an upper portion 115 of the dispensing chamber 105, through the center of the obstructor 120, through a lower portion 125 of the dispensing chamber 105, and through a centering piece 150. The membrane pin 130 guides the obstructor 120 as it is moved between the closed and the open position, ensuring that the obstructor 120 remains aligned. The walls 135 of the dispensing chamber 105 are angled in a manner that promotes a proper seal between the obstructor 120 and the walls 135 of the dispensing chamber 105 each time the obstructor 120 is moved from the open to the closed position.

The membrane 110 and the membrane pin 130 may form one continuous piece of material with the dispenser shell 100. For example, polyurethane is a suitable material that can be used to mold the dispenser shell 100, including the membrane 110 and the membrane pin 130. Polyurethane B-601 and polyurethane B-614 are examples of suitable polyurethanes that may meet FDA standards for the shell. Texin® 255 resin, which is a polyester based thermoplastic polyurethane made by Bayer Corporation is another example of a suitable material, which may be used to form the dispenser shell and membrane by injection molding. A thickness of membrane 110 in the range between 0.08 cm (0.030") and 0.14 cm (0.055"), and preferably a thickness of about 0.10 cm (0.040"), are appropriate for the above examples of suitable materials. When the membrane 110 is fashioned from the material and widths provided in these examples, a depression of membrane 110 of about 0.2 cm (0.08") is sufficient to dispense fluid. It is to be understood that in alternate embodiments of this invention, the membrane 110, the membrane pin 130 and the dispenser shell 100 may be formed from more than one piece of material.

The dispenser shell 100 has a threaded region 190 for removably attaching to the screw top 280 of a bottle 290, such as a carbonated beverage bottle.

Figure 3:
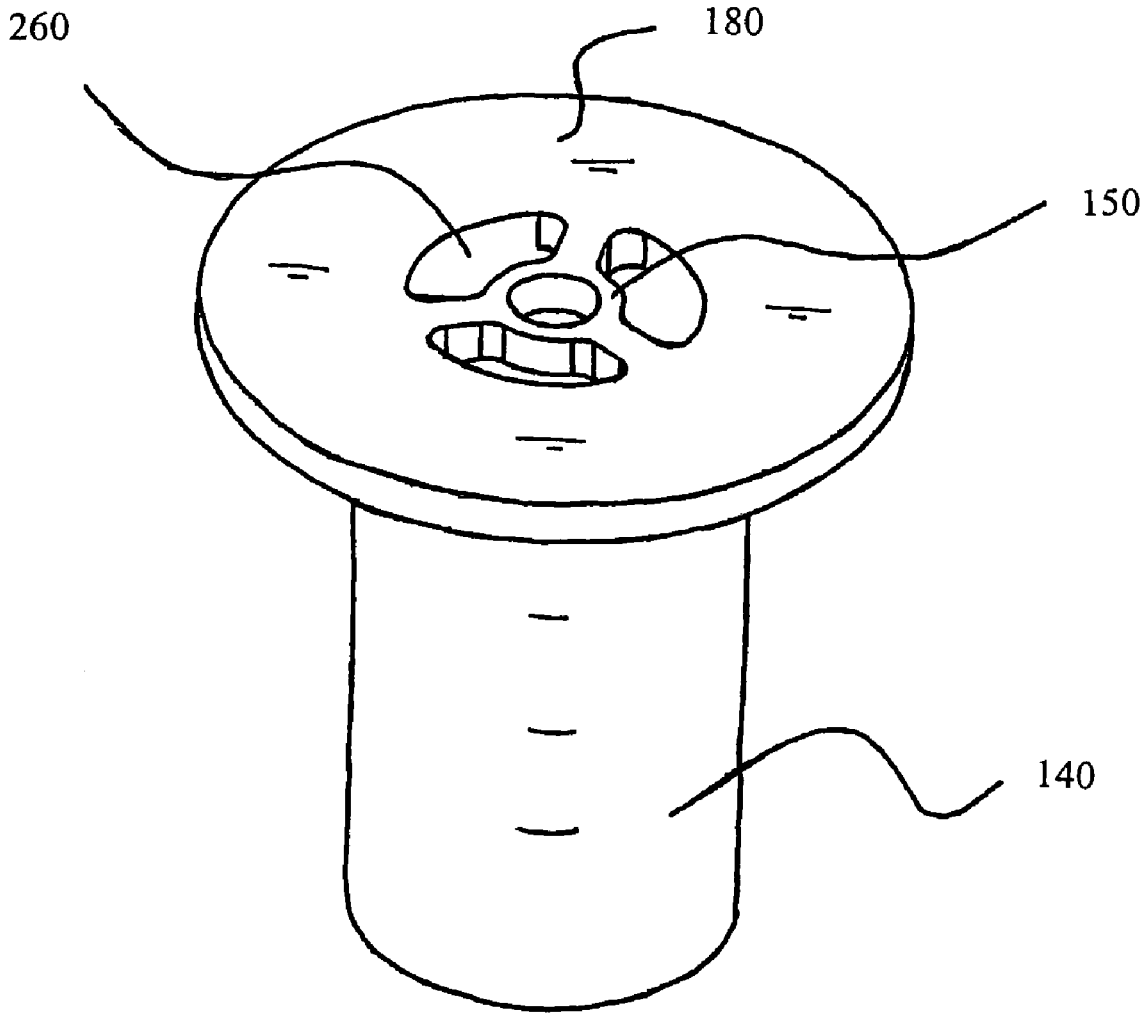
FIG. 3 is a perspective view of the centering piece of FIG. 1.
Figure 4:
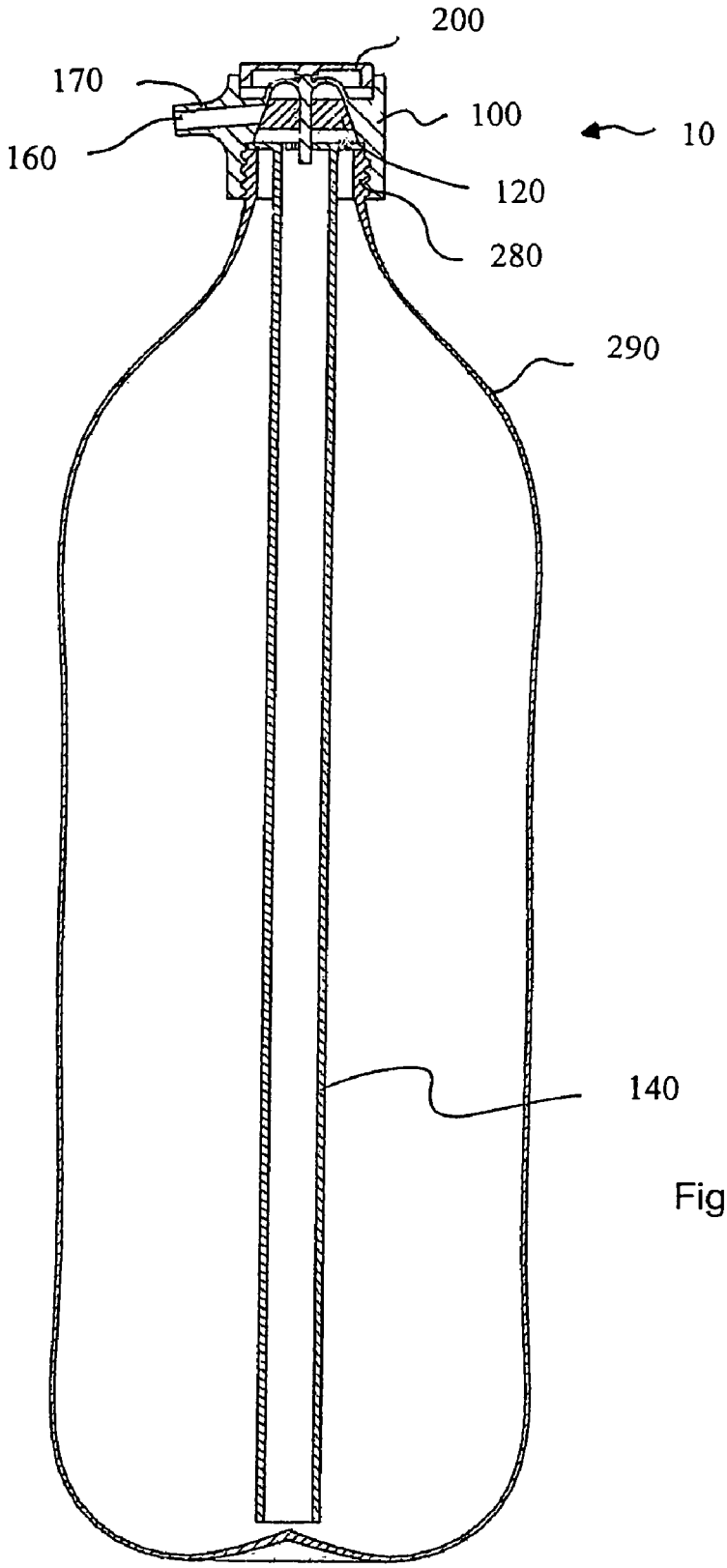
FIG. 4 is a cross-sectional side view of the dispenser of FIG. 1 attached to a bottle.

The centering piece 150 is coupled to a bottle closure seal 180, which provides a fluid tight seal between the lower dispensing chamber 125 and the upper portion of the bottle 290. The centering piece 150 is further coupled to a siphon 140, which is shown in truncated form in FIGS. 1, 2, 3 and 5. As shown in FIG. 4, the siphon 140 may extend from the bottom of the beverage bottle up to the centering piece 150 for passage of fluid therethrough. When the dispenser 10 is attached to a bottle 290 containing pressurized liquid such as a carbonated beverage, pressure from within the bottle 290 creates a force that pushes liquid through the siphon 140 towards the lower portion 125 of the dispensing chamber 105. This pressure exerts a force to bias the obstructor 120 into the upward or closed position. When the membrane 110 is a resilient polyurethane as described above, the membrane 110 holds the obstructor 120 against the walls 135 of the dispensing chamber 105 with a force of about 2 N, which is a sufficient force to maintain the obstructor 120 in the closed position even if there is no pressure in the bottle 290.

Figure 2:
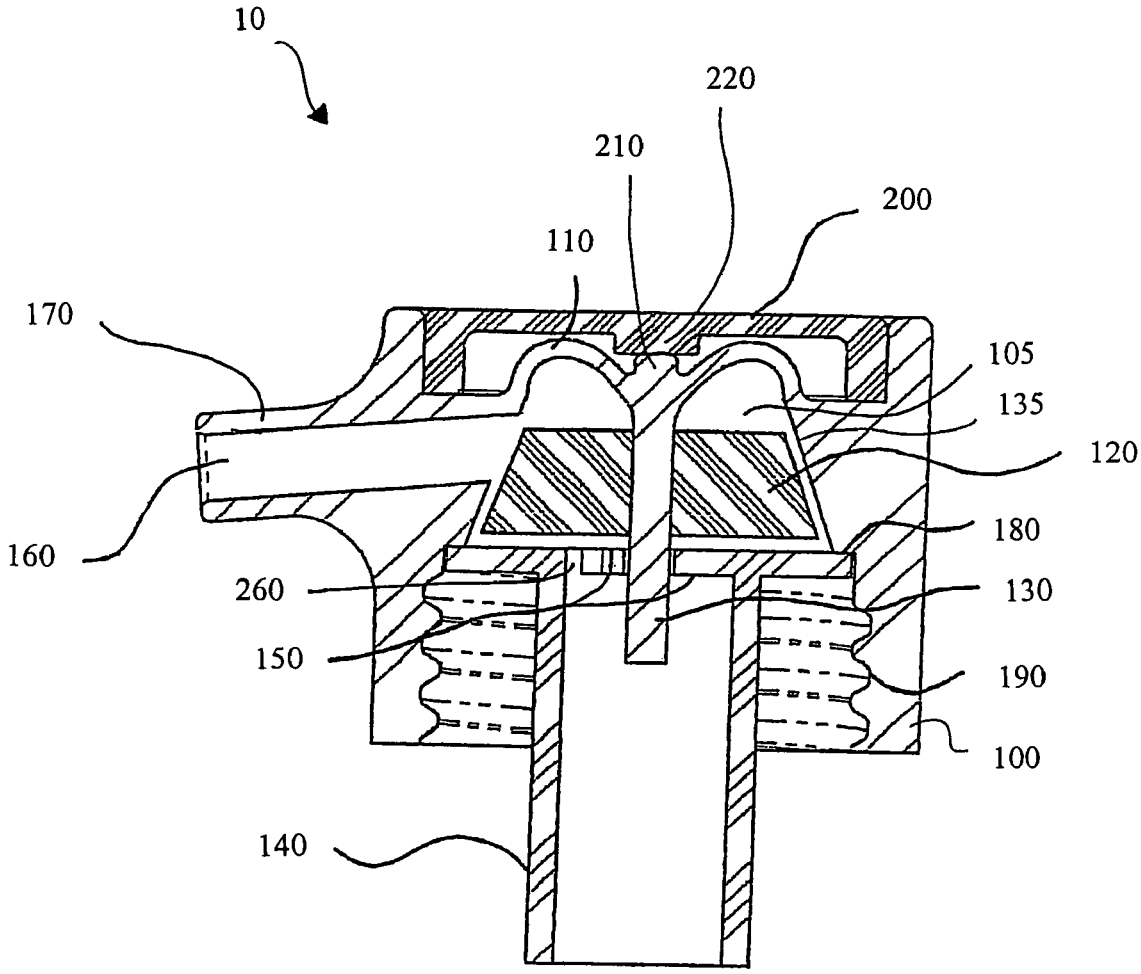
FIG. 2 is a cross-sectional side view of the dispenser of FIG. 1 shown in the open position.

When the dispenser 10 is in the open position, as shown in FIG. 2, fluid can pass through the siphon 140 from the bottom of the bottle 290, through an inlet 260, to the lower portion 125 of the dispensing chamber 105, around the obstructor 120, and out the outlet of the dispensing shell 100 through the dispensing channel 160. The centering piece 150, the bottle closure seal 180 and the siphon 140 may be formed of a single unitary material as shown in FIG. 3. The bottle closure seal 180 forms a fluid tight seal with the dispenser shell 100. The fluid tight seal can be achieved by pressure from firmly attaching the dispenser 10 to the beverage bottle, or by any suitable sealing means known in the art.

It is to be understood that this invention can be practiced without a siphon 140, closure seal 180 and/or centering piece 150 shown in FIG. 3, for example, for dispensing non-carbonated beverages. Without a siphon 140, liquid can enter the lower portion 125 of the dispensing chamber 105 by squeezing or tilting the bottle 290. Liquid in the lower portion 125 of the dispensing chamber 105 can then be expelled by depressing the membrane 110.

A button 200 is provided in dispenser 10 to facilitate the depression of the membrane 110. The button 200 has a reinforced area 220 that is positioned in contact with a membrane knob 210. The membrane 110 may have a resilient nature that biases the membrane 110, and in turn the button 200, to the upward and closed position. It may also be noted that when dispensing pressurized contents from a bottle 290, the pressurized contents exert an upward force on the obstructor 120, that biases the obstructor 120 and membrane 110 into the closed position.

When the button 200 is depressed, the membrane 110 is depressed, displacing the membrane pin 130, which in turn displaces the obstructor 120 in a downward direction. This allows fluid to travel through the siphon 140, through the inlet 260 in the centering piece 150, through the lower dispensing chamber 125, around the obstructor 120 and out the dispensing channel 160. The button 200 may be attached to the dispensing shell 100 by any suitable attachment means, such as by snap fit shown in FIG. 1. Button 200 has a lip 240 that snaps past a ridge 250 in the dispensing shell 100. It is to be understood that the button may be attached to the dispensing shell 100 by any suitable means.

An example of the relative size and position of the dispenser 10 with respect to a beverage bottle 290 is shown in FIG. 4. Although the siphon 140 is shown in truncated form in FIGS. 1, 2, 3 and 5, FIG. 4 shows that the siphon may extend from the dispenser 10 to the bottom of the bottle 290 for transporting fluid from the bottom of the bottle 290 to the lower portion 125 of the dispensing chamber 105.

The operation of the dispenser 10 is initiated by depression of the membrane 110. Depression of the membrane 110 may be achieved by a number of different methods, such as direct pressure on the membrane 110, indirect pressure on the membrane 110 by a button 200, pressure by a lever such as disclosed in U.S. Pat. No. 4,860,932, or a force exerted by a twist top 320 as shown in dispenser 300.

Figure 5:
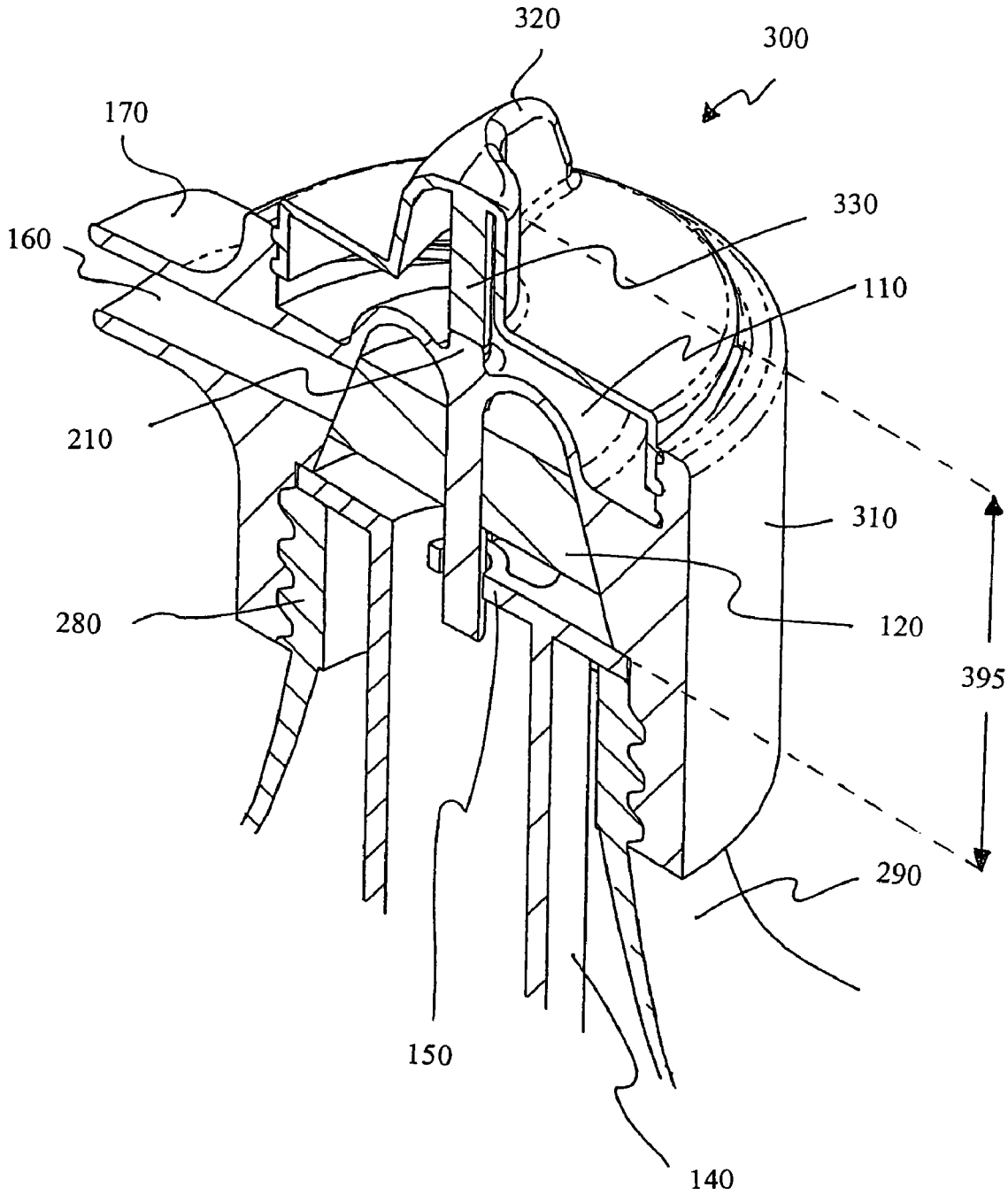
FIG. 5 is a perspective cross-sectional view of a twist top-operated embodiment shown in the closed position.
Figure 6:
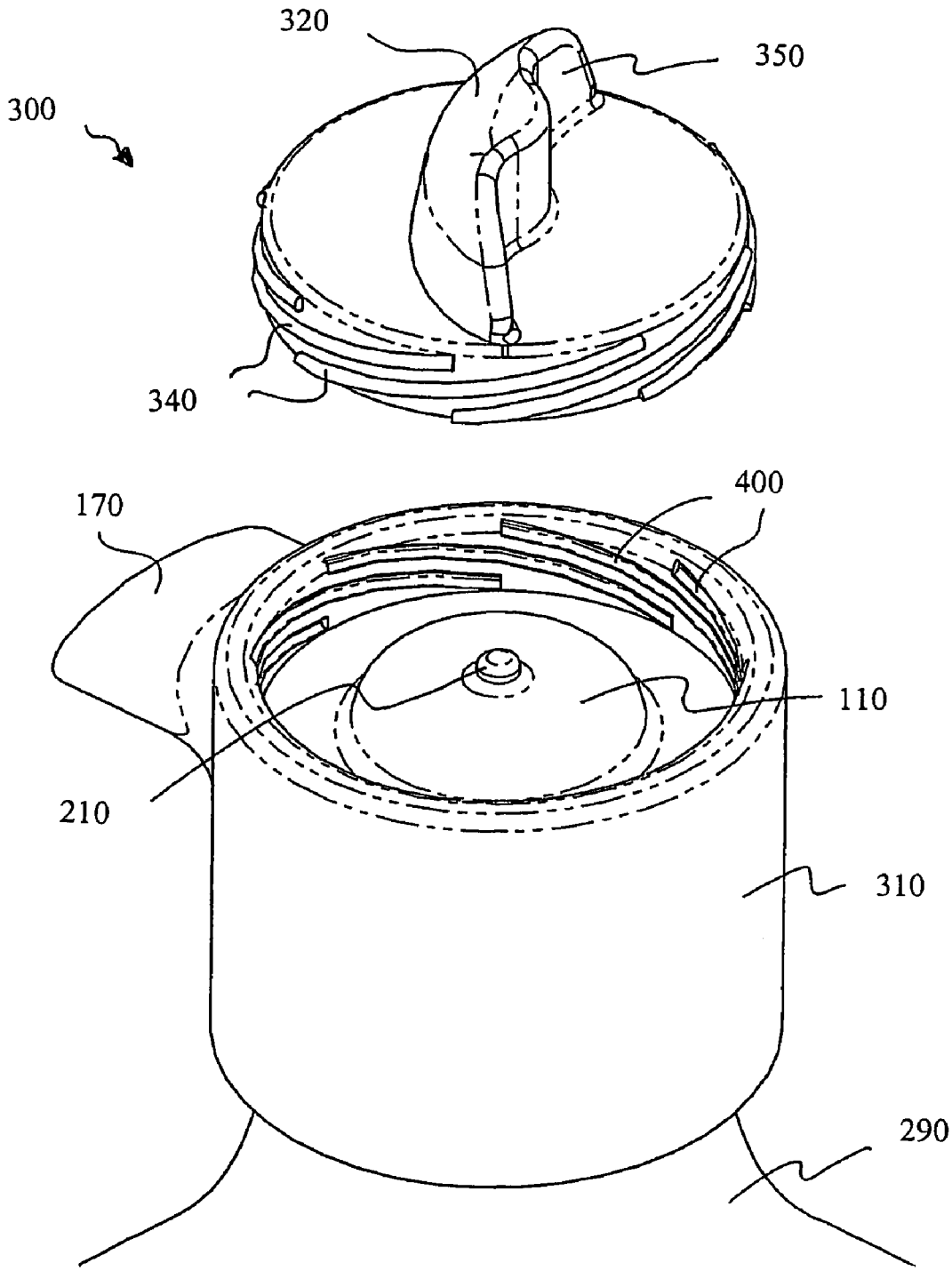
FIG. 6 is a perspective exploded view of the dispenser shell of FIG. 5.

With reference to FIGS. 5 and 6, dispenser 300 has a twist top 320 attached to the dispensing shell 310 by a tongue 340 and groove 400 arrangement. The twist top 320 has a twist top pin 330 that presses against the membrane knob 210. Twisting the twist top 320 in one direction, such as clockwise, lowers the twist top 320 with respect to the shell 310. This in turn causes a downward force to be applied by the twist top pin 330 against the membrane knob 210, causing displacement of the membrane 110, resulting in the opening of the dispenser as previously described in relation to dispenser 10. Twisting the twist top 320 in the opposite direction, such as counter-clockwise, raises the twist top 320 with respect to the dispensing shell 310. This in turn reduces the force between the twist top pin 330 and the membrane knob 210 such that the membrane 110 may return to its biased position, closing the dispenser 300.

The shape of the spout 170 is not important for the functioning of this invention. Accordingly, FIGS. 1 and 7 illustrate different variations on the shape of the spout 170.

FIG. 6 shows a perspective exploded view of the twist top 320 having an upper ridge 350 that allows simple one hand operation of the dispenser 300, by pressure of the thumb on one side of the ridge to open the dispenser, and by pressure of the thumb on the other side of the ridge to close the dispenser 300. It is to be understood that the shape of the twist top 320 is highly variable, and could include novelty items such as cartoon characters, company logos or other distinctive designs that allow twist operation of the dispenser 300.

An advantage of the invention is that the distances 95, 195 & 395 measured from the uppermost portion of the bottle 290 to the top of the membrane knob 210, to the top of the button 200, and/or to the top of the twist top 320 can be between about 1 cm to 4 cm, and more preferably between about 1.0 cm to 2.5 cm, such that the dispenser can fit on existing carbonated beverage bottles while the bottles are stacked in existing crates or stored in refrigerators, cabinets or furniture based on current standard sizes of bottles.

Figure 7:
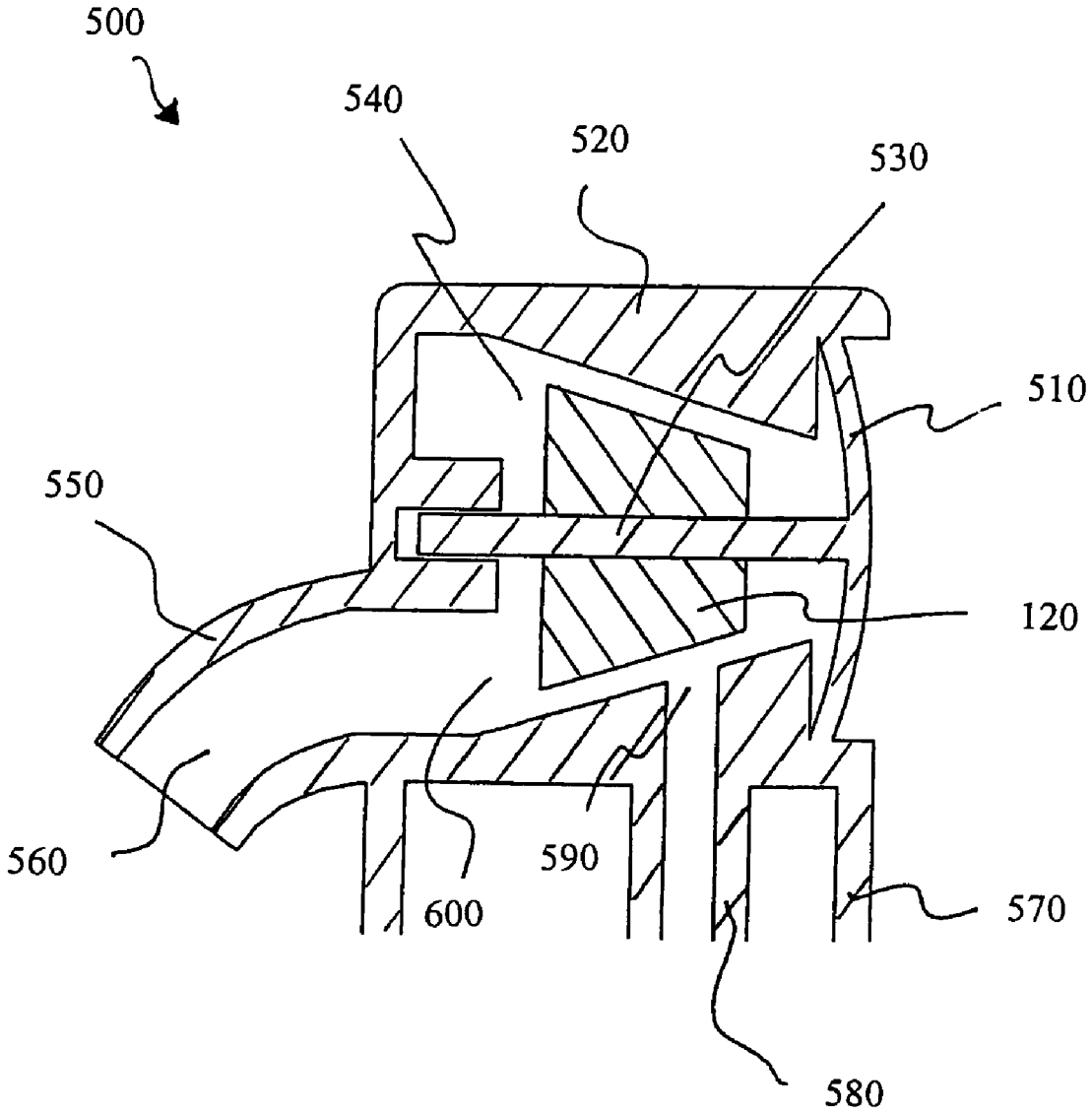
FIG. 7 is a cross-sectional side view of a side activated dispenser.

FIG. 7 shows a side activated dispenser 500 having a membrane 510 that can be activated by exerting a force in a direction perpendicular to the siphon 580. The operation of the side activated dispenser 500 is similar to the previously described embodiments. Depression of the membrane 510, displaces the membrane pin 530, which in turn displaces the obstructor 120, moving the obstructor from a closed position to an open position. When in the open position, fluid can flow up the siphon 580, through the inlet 590 into the dispensing chamber 540, past the obstructor 120, through the outlet 600 of the dispensing chamber 540 and out the dispensing channel 560 of the spout 550. Dispenser shell 520 may be attached to a bottle in attachment area 570 by any suitable means, including being formed of a single piece of unitary construction with the bottle.

When the present invention is used for dispensing a pressurized liquid, the open position results in a unidirectional flow of fluid, namely expelling the pressurized liquid until the pressurized liquid is no longer in contact with the siphon, such as when container is empty. Normal operation of the invention for dispensing carbonated beverages expels only liquid, until empty, thus maintaining bottle pressure and beverage carbonation. Since fluid from outside the bottle will not flow into the bottle while the bottle contents are under pressure, the potential for contamination of the product is significantly reduced or eliminated.

In embodiments of the invention wherein the dispenser is fabricated directly on the top of a bottle, this feature combined with the unitary directional flow of the contained pressurized beverage, will provide assurance to consumers and suppliers that the contents of the bottle have not been easily altered or refilled after manufacturing. It would be possible to fill or refill a bottle having a dispenser directly fabricated thereon by using a special device, such as exerting pressure and fluid through the spout 160 or 560 when the dispenser 10, 300 or 500 is in the open position.

As will be apparent to those skilled in the art in the light of the foregoing disclosure, many alterations and modifications are possible in the practice of this invention without departing from the scope thereof. For example, although the invention has been described with a single membrane pin, the invention can be practiced with a plurality of membrane pins. Further, if the walls of the dispensing chamber are appropriately shaped in relation to the obstructor, a proper seal may be achieved without a centering piece and/or without a membrane pin that passes completely through the obstructor. Accordingly, the scope of the invention is to be construed in accordance with the substance defined by the following claims.

What is claimed is:

1. A dispenser for dispensing fluid from a container, the dispenser comprising:

a shell having an inlet and a dispensing cutlet, a dispensing chamber, and a mechanism for attaching the shell in a fluid tight seal to a top portion of the container;

a membrane coupled to the shell in a fluid tight seal;

a membrane pin coupled to the membrane and to an obstructor such that depression of the membrane results in displacement of the obstructor; and the obstructor being movable between a closed position forming a fluid tight seal on the dispensing outlet preventing fluid flow between the inlet and the dispensing outlet and an open position allowing fluid flow between the inlet and the dispensing outlet;

wherein the fluid tight seal between the obstructor and the dispensing outlet comprises a conical wall of the obstructor directly sealing against the dispensing outlet.

2. The dispenser of claim 1 wherein the membrane is resilient and biases the membrane and the obstructor, through coupling with the membrane pin, into the closed position.

3. The dispenser of claim 1 further comprising a siphon coupled in a fluid tight seal to the shell, defining a passageway from the container to the lower region of the dispensing chamber.

4. The dispenser of claim 3, further comprising a centering piece coupled to the shell for centering the obstructor within the shell, wherein the siphon and the centering piece comprise a continuous piece of unitary material.

5. The dispenser of claim 1 wherein the mechanism for attaching the shell to the top portion of the container is a screw connection.

6. The dispenser of claim 1 wherein the mechanism for attaching the shell to the top portion of the container is a snap connection.

7. The dispenser of claim 1 wherein the container is a bottle for dispensing carbonated beverages.

8. The dispenser of claim 1 wherein a height of the dispenser when attached to a container and measured between an uppermost portion of the container and an uppermost portion of the dispenser is between about 1 cm and about 4 cm.

9. The dispenser of claim 8 wherein the height of the dispenser is between about 1.0 cm and about 2.5 cm.

10. The dispenser of claim 1 wherein the membrane pin passes through the obstructor and through a centering piece coupled to the shell.

11. The dispenser of claim 1 wherein the shell, the membrane and the membrane pin together comprise a continuous piece of unitary material.

12. The dispenser of claim 11 wherein the single piece of unitary material is comprised of polyurethane.

13. The dispenser of claim 1 further comprising a button coupled to the shell, the button being in frictional communication with the membrane and movable between an upright position and a depressed position.

14. The dispenser of claim 13 wherein a height of the dispenser when attached to a container and measured between an uppermost portion of the container and an uppermost portion of the dispenser is between about 1 cm and about 4 cm.

15. The dispenser of claim 14 wherein the height of the dispenser is between about 1.0 cm and about 2.5 cm.

16. The dispenser of claim 1 further comprising a lever coupled to the shell, the lever being in frictional communication with the membrane and movable between an upright position and a depressed position.

17. The dispenser of claim 16 wherein a height of the dispenser when attached to a container and measured between an uppermost portion of the container and an uppermost portion of the dispenser is between about 1 cm and about 4 cm.

18. The dispenser of claim 1 further comprising a twist top coupled to the shell, the twist top being in frictional communication with the membrane and movable between an upright position and a depressed position.

19. The dispenser of claim 18 wherein a height of the dispenser when attached to a container and measured between an uppermost portion of the container and an uppermost portion of the dispenser is between about 1 cm and about 4 cm.

20. The dispenser of claim 19 wherein the height of the dispenser is between about 1.0 cm and about 2.5 cm.

21. The dispenser of claim 1 wherein the obstructor is a substantially truncated cone shape.

22. The dispenser of claim 21 wherein a base of the obstructor is positioned such that pressure from inside the container biases the obstructor to the closed position.

23. The dispenser of claim 1 characterized by exactly two injection molded parts.

* * * * *